US006444289B1

(12) United States Patent
Ernest

(10) Patent No.: US 6,444,289 B1
(45) Date of Patent: Sep. 3, 2002

(54) PERFORATED FACED INSULATION ASSEMBLY

(75) Inventor: Frederick R. Ernest, St. Louisville, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/386,799

(22) Filed: Aug. 31, 1999

(51) Int. Cl.[7] ..... B32B 3/24

(52) U.S. Cl. ..... 428/138; 138/149; 454/228; 454/237; 454/233

(58) Field of Search ..... 428/138; 138/149; 454/228, 237, 233

(56) References Cited

U.S. PATENT DOCUMENTS

| | | | | | |
|---|---|---|---|---|---|
| 4,034,826 | A | * | 7/1977 | Andrews | 181/36 B |
| 4,037,751 | A | | 7/1977 | Miller et al. | 428/593 |
| 4,235,303 | A | | 11/1980 | Dhoore et al. | 181/214 |
| 4,326,909 | A | * | 4/1982 | Slavik | 156/253 |
| 4,726,985 | A | * | 2/1988 | Fay et al. | 428/228 |
| 4,784,891 | A | * | 11/1988 | Shickel | 428/137 |
| 5,196,253 | A | * | 3/1993 | Mueller et al. | 428/138 |
| 5,358,781 | A | | 10/1994 | Sakai et al. | 428/285 |
| 5,783,268 | A | * | 7/1998 | Noonan et al. | 428/34.5 |
| 5,868,891 | A | | 2/1999 | Weir et al. | 156/230 |

FOREIGN PATENT DOCUMENTS

| | | |
|---|---|---|
| CA | 2 147 443 A | 10/1995 |
| DE | 297 10 491 U | 3/1998 |

* cited by examiner

*Primary Examiner*—William P. Watkins, III
(74) *Attorney, Agent, or Firm*—Inger H. Eckert; Stephen W. Barns

(57) ABSTRACT

An insulation assembly for a forced gas unit comprises a facing layer and a porous insulation layer joined together by an adhesive. The facing layer includes pressure-balancing and non-pressure-balancing regions. Perforations are formed in the facing layer after the facing layer and the insulation layer are joined together and after the adhesive is cured. The perforations allow gas to flow through the facing layer so as to adequately balance the static pressures acting on the exposed and non-exposed surfaces of the facing layer.

13 Claims, 3 Drawing Sheets

PERFORATED FACED INSULATION ASSEMBLY

This invention relates in general to insulation assemblies and in particular to a perforated faced insulation assembly for a forced gas unit and a method of making the perforated faced insulation assembly.

BACKGROUND OF THE INVENTION

The term "forced gas unit", as used in this application, means a unit or appliance that includes a blower or fan for forcing the movement of gas, including such equipment as air handling units including air ducts and heating, ventilating, and air conditioning (HVAC) units. Some HVAC units are provided with insulation assemblies for acoustic and/or thermal purposes. Conventional insulation assemblies used in HVAC units typically include a facing layer adhered to a porous insulation layer. The facing layer is typically non-porous such that the facing layer acts as a moisture barrier between air circulated within the HVAC unit and the insulation layer. As such, the facing layer is useful in preventing or at least limiting the damage caused by the condensation of water vapor on or within the insulation layer. In addition, the facing layer acts as windshield, which prevents the flow of air directly across the insulation layer. The importance of preventing or at least limiting the flow of air directly across the insulation layer is twofold. First, in the absence of the facing layer, the insulation layer is susceptible to erosion as caused by the flow of air generated by the blower. Second, if the insulation layer were directly exposed to the flow of air generated by the blower, heat is transferable though the insulation layer by convention. By shielding the insulation layer, the facing layer significantly reduces if not eliminates the convection heat transfer component through the insulation layer. As such, the amount of heat transferred through the insulation layer shielded the facing layer is significantly less than if the facing layer were absent. Accordingly, an insulation assembly having a facing layer provides better thermal insulation properties than an insulation layer without a facing layer. An advantage of using an insulation assembly having improved thermal insulation properties is that the potential for water vapor condensing on the exterior of the HVAC unit is reduced.

A problem with these types of insulation assemblies is that in certain applications the facing layer may become separated from the insulation layer. Specifically, the air flow within the HVAC unit may create a relatively low static pressure region on the exterior or exposed surface of the facing layer when compared to the static pressure acting on the interior or non-exposed surface of the facing layer. The resulting pressure differential between the exposed and non-exposed surfaces of the facing layer may cause the corresponding portion of the facing layer to balloon. This ballooning effect may cause the adhesive bond between the facing layer and the insulation layer to fail, which results in the separation of facing layer and the insulation layer.

An objective of this invention is to reduce the static pressure differential between opposite surfaces of a facing layer of an insulation assembly subjected to the forced movement of gas in a forced gas unit.

Another objective of this invention is to reduce the likelihood of a facing layer and an insulation layer of an insulation assembly from becoming separated from each other when subjected to the forced movement of gas in a forced gas unit.

SUMMARY OF INVENTION

This invention concerns an insulation assembly for a forced gas unit that achieves the above objects and other objects not specifically enumerated. The insulation assembly comprises an insulation layer and a facing layer attached to each other. The facing layer has a pressure-balancing region with perforations formed in the facing layer. The perforations allow sufficient gas flow through the facing layer for adequately balancing the pressures acting on the facing layer within the pressure-balancing region.

According to another embodiment of this invention there is provided a method for making an insulation assembly for a forced gas unit comprising the steps of providing an insulation supply including an insulation layer and a facing layer attached to each other, cutting the insulation supply and forming perforations in the facing layer.

Various objects and advantages of this invention will become apparent to those skilled in the art from the following detailed description of the preferred embodiment, when read in light of the accompanying drawings.

DETAILED DESCRIPTION OF THE PREFERRED EMBODIMENTS OF THE INVENTION

Figure 1:
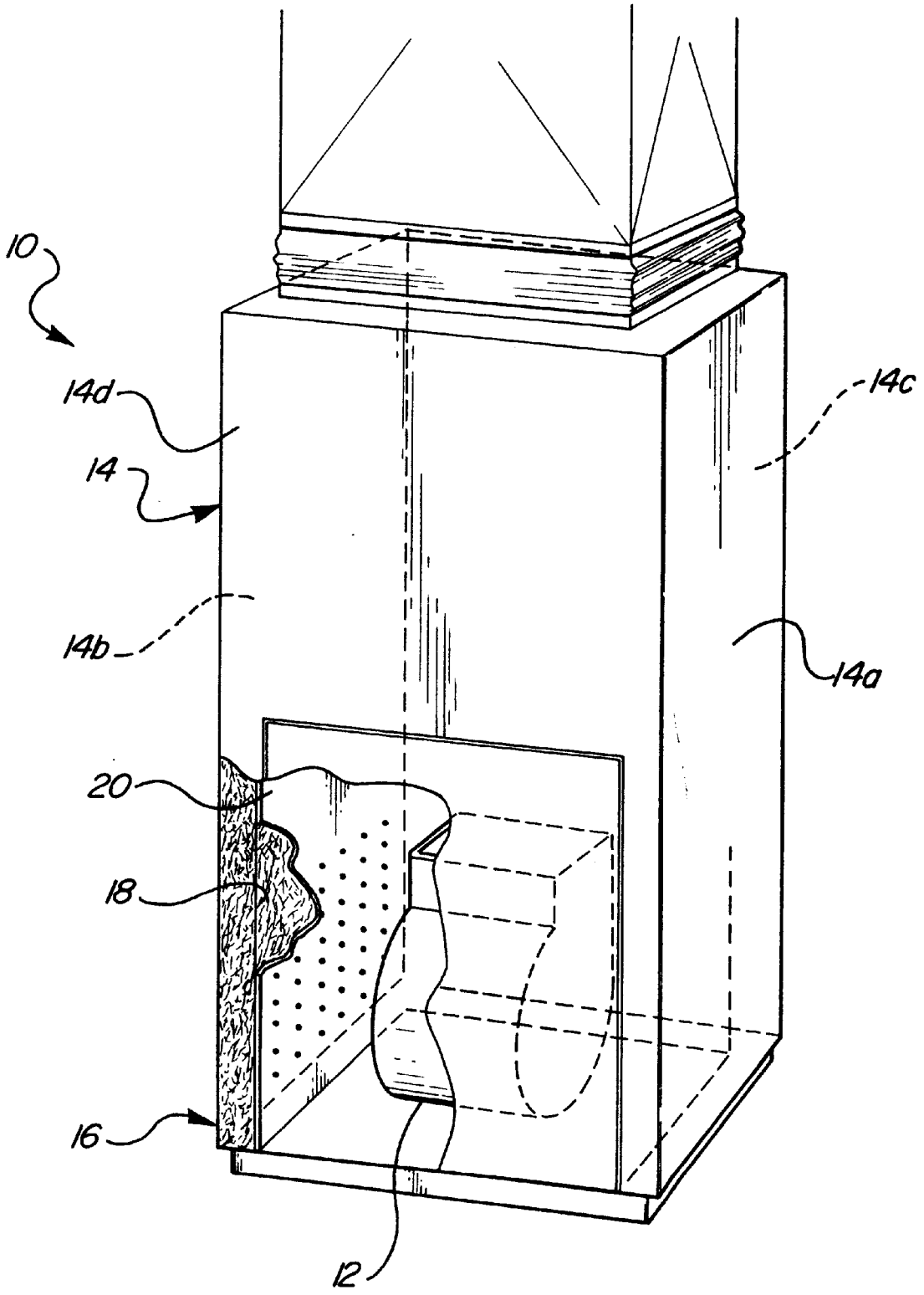
FIG. 1 is a partially cut away perspective view of an insulation assembly according to this invention, shown installed on a forced gas unit.

A forced gas unit is shown generally at 10 in FIG. 1. As defined above, the term "forced gas unit" means a unit or appliance including a blower or fan for forcing the movement of gas. Examples of forced gas units include air handling units such as air ducts and heating, ventilating, and air conditioning (HVAC) units. Other examples of forced gas units include refrigerators, freezers, clothes dryers and other appliances. The forced gas unit 10, as shown, is representative of an HVAC unit 10 including a blower or fan 12 disposed in a housing 14. The housing 14 includes side panels 14*a* and 14*b* interconnected by a rear panel 14*c* and a front panel 14*d*. Typically, the front panel 14*d* or a portion thereof is removable to allow access to the inside of the housing 14. An insulation assembly according to this invention, generally indicated at 16, is attached to the inner surfaces of the side and rear panels 14*a*–14*c*. A separate insulation assembly (not shown) similar to the insulation assembly 16 may also be attached to the front panel 14*d*. Alternatively, the insulation assembly 16 may be modified so as to be attached to all four panels 14*a*–14*d*. Although the insulation assembly 16 is indicated as being attachable to all four panels 14*a*–14*d*, it is to be understood that for various reasons that only some of the panels may be provided with an insulation assembly.

Figure 2:
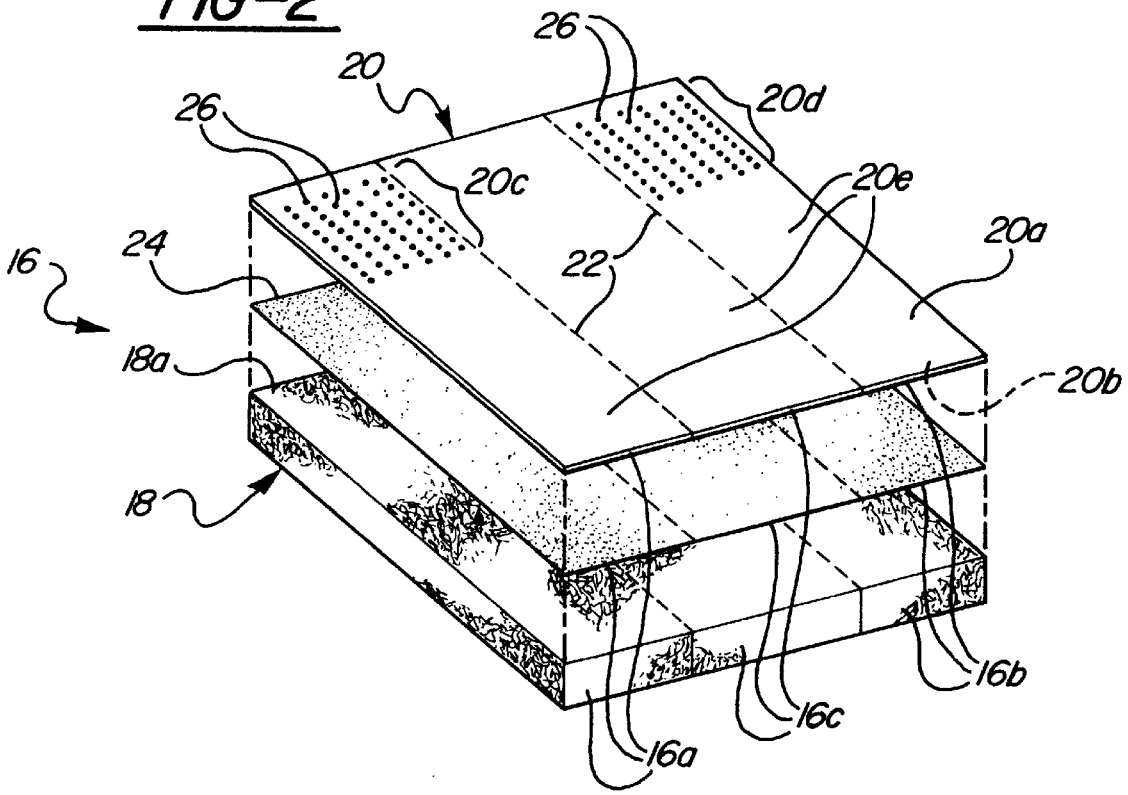
FIG. 2 is an exploded perspective view of the insulation assembly shown in FIG. 1.

Referring to FIGS. 1 and 2, the insulation assembly 16 includes a porous insulation layer 18 attached to a facing layer 20. The insulation assembly 16 includes two columns of spaced-apart folding slits 22 formed through each of the insulation layer 18 and facing layer 20. The folding slits 22 facilitate the folding of the insulation assembly 16 into a "C" shape for installation in the HVAC unit 10. Preferably, the folding slits 22 are formed after the insulation layer 18 and the facing layer 20 are attached to each other. The columns of folding slits 22 divide the insulation assembly into a first side panel portion 16*a*, a second side panel portion 16*b* and a rear panel portion 16*c*. When installed in the housing 14, the panel portions 16*a*, 16*b* and 16*c* align with the panels 14*a*, 14*b* and 14*c*, respectively. It should be appreciated that the insulation assembly 16 can be folded without the folding slits 22, and that means other than slits, such as creases (not shown) can be used to facilitate folding. It also should be appreciated that that while the insulation assembly 16 is shown as generally square, the insulation assembly 16 may be formed as any shape and may include any number of panel portions. In addition, each of the panel portions 16*a*–16*c* may be formed separately to form separate insulation assemblies.

As shown in FIG. 2, the insulation layer 18 has a facing surface 18*a* and an attachment surface (not shown), which is opposite the facing surface 18*a*. The insulation layer 18 may be formed from any suitable acoustical and/or thermal insulating material such as woven or non-woven fiberglass, mineral fibers, polymeric fibers, or the like. When attaching the insulation assembly 16 to the housing 14, the attachment surface is preferably adhered to the housing 14 by an adhesive. Alternatively, any other attachment means can be used.

As shown in FIG. 2, the facing layer 20 has an outer surface 20*a* and an inner surface 20*b*, which is opposite the outer surface 20*a*. The facing layer 20 acts as a moisture barrier for limiting the amount of water vapor condensing in or on the insulation layer 18. In addition, the facing layer 20 acts as a windshield for limiting the amount of erosion to the insulation layer 18 and for limiting the amount of heat transferred by convention through the insulation layer 18. The facing layer 20 is preferably formed from a moisture resistant material such as aluminum foil, foil reinforced paper, foil scrim paper, polymeric material, or the like. The inner surface 20*b* is adhered to the facing surface 18*a* by an adhesive 24. As can be appreciated, depending on a given application, the adhesive 24 may be selected from a class of adhesives covering a range of adhesive properties. Preferably, the adhesive 24 is applied to the facing surface 18*a*. Alternatively, the adhesive 24 may be applied to the inner surface 20*b* in addition to or in replacement of being applied to the facing surface 18*a*. The adhesive 24 should be applied to a sufficient area of the facing surface 18*a* and/or the inner surface 20*b* so that the facing layer 20 and the insulation layer 18 are adequately adhered to each other when subjected to the forced air movement of the HVAC unit 10. With respect to typical HVAC applications, it is preferable that the adhesive 24 be applied to nearly 100 percent of the facing surface 18*a* and/or inner surface 20*b*.

The facing layer 20 includes pressure-balancing regions 20*c* and 20*d* within the side panel portions 16*a* and 16*b*, respectively. When installed in the HVAC unit 10, each pressure-balancing region 20*c*, 20*d* is positioned adjacent an area of relatively high air flow rates. The facing layer 20 further includes a non-pressure-balancing region 20*e*, which represents the remaining portion of the facing layer 20. In contrast to the pressure-balancing regions 20*c*, 20*d*, which represent areas of the facing layer 20 that are subjected to relatively high air flow rates, the non-pressure-balancing region 20*e* represents an area of the facing layer 20 that is subjected to relatively low air flow rates.

Figure 3:
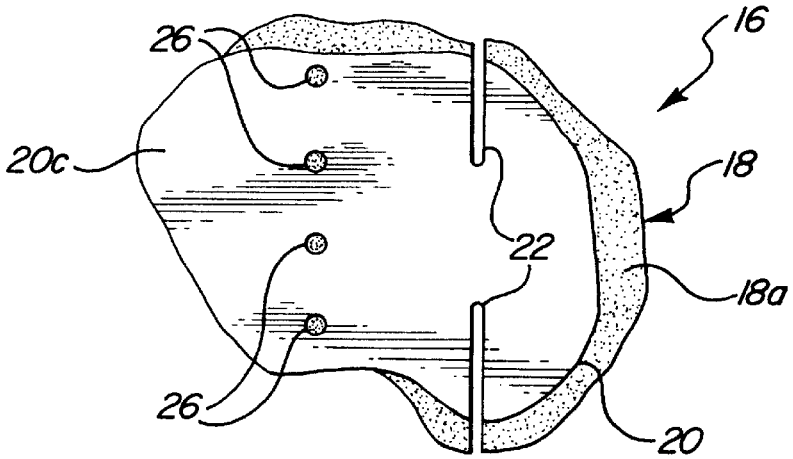
FIG. 3 is a top plan view of an enlarged portion of the insulation assembly shown in FIG. 1.

The pressure-balancing regions 20*c*, 20*d* each include perforations 26 formed through the facing layer 20. Preferably, the perforations 26 are circular as best shown in FIG. 3. Alternatively, the perforations 26 may be any desired shape such as square, oval, irregular or the like. The perforations 26 are preferably formed after the facing layer 20 has been adhered to the insulation layer 18, and more preferably, after the adhesive 24 has been cured. By forming the perforations 26 after the facing layer 20 is adhered to the insulation layer 18 and after the adhesive 24 is cured, the perforations 26 are substantially void or free of the adhesive 24. Conversely, if the perforations 26 were formed in the facing layer 20 prior to curing the adhesive 24, the adhesive 24 could completely or at least partially fill the perforations 26. The importance of the perforations 26 being substantially void of the adhesive 24 is twofold. First, forced gas units benefiting from this invention may be subject to various flame spread and smoke test standards. In particular, HVAC units are required to pass United Laboratories flame spread and smoke development test standard UL 2550. In order to pass the test standard defined in UL 2550, the perforations 26 need to be substantially void of the adhesive 24. Second, if the adhesive 24 were present in the perforations 26, the intended function of the perforations 26, which is to allow sufficient gas flow through the facing layer 20, would be defeated or at least compromised. Specifically, the flow rates across the pressure-balancing regions 20*c*, 20*d* cause a relatively large drop in the static pressure acting on the outer surface 20*a* within the pressure-balancing regions 20*c*, 20*d*. In turn, the drop in the static pressure acting on the outer surface 20*a* creates a relatively high difference in the static pressures acting on the outer and inner surfaces 20*a*, 20*b* within the pressure-balancing regions 20*c*, 20*d*. The perforations 26 allow for the venting of the relatively high static pressure acting on the inner surface 20*b* to balance or at least adequately reduce the pressure differential between the static pressures acting on the outer and inner surfaces 20*a*, 20*b*. If the flow of air through the perforations 26 is restricted by the presence of the adhesive 24 within the perforations 26, the relatively high static pressure differential between the outer and inner surfaces 20*a*, 20*b* could cause the pressure-balancing regions 20*c*, 20*d* to balloon or be drawn away from the side panels 14*a*, 14*b*. In turn, this ballooning effect could cause the facing layer 20 and the insulation layer 18 to become separated. By allowing air to flow through the facing layer 20, the perforations 26 reduce the static pressure differential between the outer and inner surfaces 20*a*, 20*b*. As such, the facing layer 20 is less likely to balloon. In turn, the facing layer 20 and the insulation layer 18 are less likely to become separated. The flow rates associated with the nonpressure-balancing region 20*e* do not give rise to static pressure differentials that would jeopardize the retention between the facing layer 20 and the insulation layer 18. Accordingly, it is not necessary to form perforations in the non-pressure-balancing region 20*e*.

An advantage of not forming perforations in the non-pressure-balancing region 20*e* is that the moisture barrier and windshield characteristics of the facing layer 20 are not unduly compromised. For the same reason that it is important to avoid forming unnecessary perforations within the non-pressure-balancing region 20*e*, it is important to limit the number and/or size of the perforations 26 formed in the pressure-balancing regions 20*c*, 20*d*.

Depending on a given application, an insulation assembly according to this invention may include any number and various sizes of pressure-balancing regions and non-pressure-balancing regions. In addition, the size and number of perforations may vary, depending on the application. For most applications, a pressure-balancing region is typically located adjacent each inlet and/or each outlet of the blower or fan. Additionally, pressure-balancing regions may be remotely located from the blower or fan depending on the flow rate profile of the forced gas unit.

As can be appreciated a variety of factors, such as the size and shape of the given forced gas unit and the size, speed, and positioning of the given blower, influence the positioning and sizes of the pressure-balancing and non-pressurebalancing regions of a given insulation assembly. These same factors influence the number and sizes of the perforations of a given facing layer. Depending on the application, adequate pressure balancing can be achieved without unduly compromising the moisture barrier and windshield attributes of a given facing layer when the area of the combined individual non-pressure-balance regions is within the range of from about 30 to about 90 percent of the total area of the facing layer. Additionally, perforations having sizes within the range of from about 0.002 to about 0.320 square inches provide adequate pressure balancing without significantly compromising the moisture barrier and windshield attributes of the facing layer. Also, adequate pressure balancing can be achieved without unduly compromising the moisture barrier and windshield attributes of the facing layer when the perforations have a concentration within the range of from about 0.5 to about 4 perforations per square inch of the pressure-balance region.

While this invention has been principally described in relationship to HVAC units, any forced gas unit utilizing an insulation assembly having a facing layer joined to an insulation layer, where it is possible for the facing layer and the insulation layer to become separated due to a static pressure imbalance acting on the facing layer, may benefit from this invention.

Figure 4:
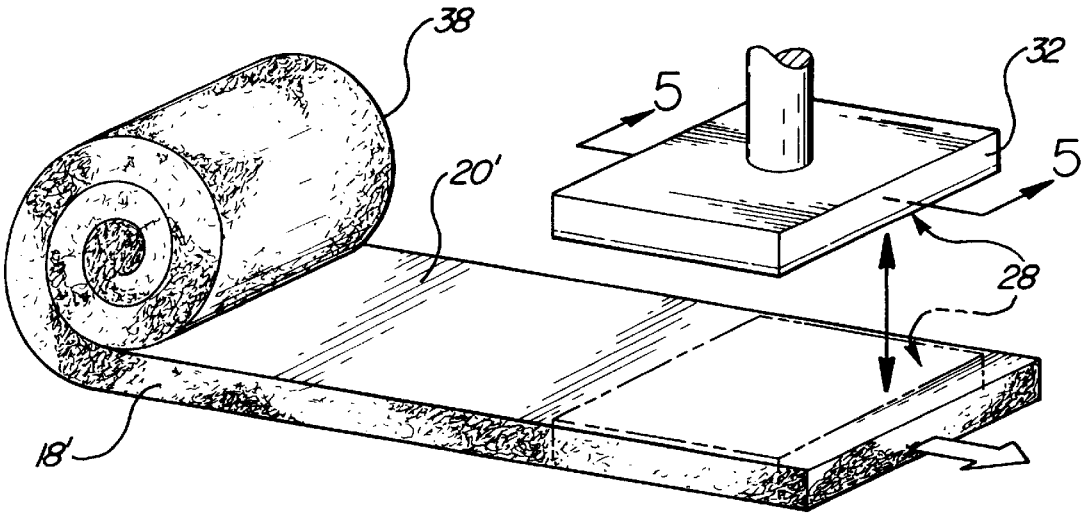
FIG. 4 is a perspective view of a die board used in making the insulation assembly shown in FIG. 1, illustrated in relationship to an insulation supply from which the insulation assembly is made.
Figure 5:
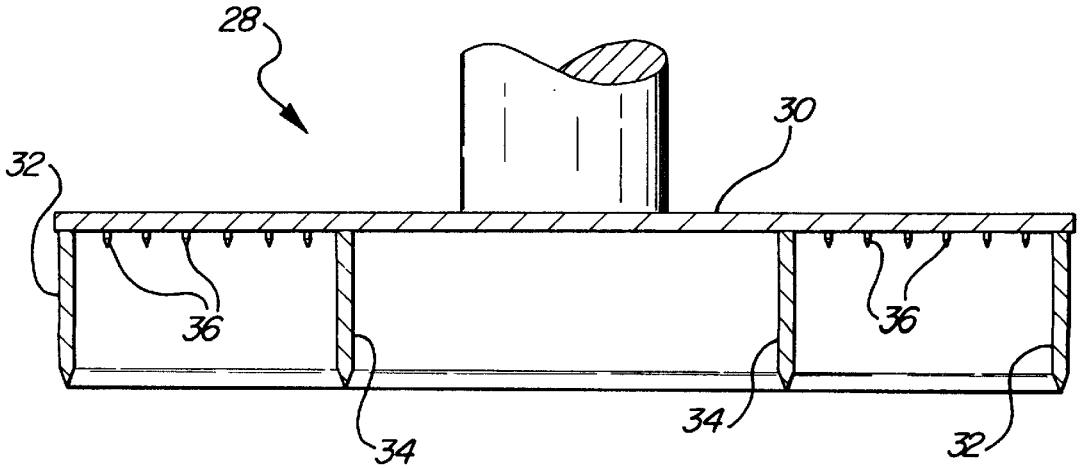
FIG. 5 is a sectional view of the die board of FIG. 4, taken along the line 5—5.

A die board used in making the insulation assembly 16 is indicated generally at 28 in FIG. 4. The die board 28 is moveably supported by a drive means (not shown) for movement between a staging position (shown in solid) and a task completion position (shown in phantom). The die board 28 is shown to be configured for vertical movement, but may be configured in a manner to provide horizontal movement, arcuate movement or any other suitable movement. The die board 28 includes a base 30 that has a shape complementary to the shape of the insulation assembly 16. A die blade 32 for forming the shape of the insulation assembly 16 extends from the perimeter of the base 30. Spaced-apart cutters 34 for forming the folding slits 22 extend from the base 30 and are arranged in a manner consistent with the desired arrangement of the folding slits 22. Spaced-apart pins or punches 36 for forming the perforations 26 extend from the base 30 and are arranged in a manner consistent with the desired arrangement of the perforations 26.

In making the insulation assembly 16, an insulation supply 38 is preferably provided in a rolled form as shown in FIG. 4. Alternatively, the insulation supply 38 may be provided in an unrolled form (not shown). The insulation supply 38 includes a supply of an insulation layer 18' and a supply of a facing layer 20' attached to each other. The insulation supply 38 is advanced in the direction as indicated in FIG. 4 until a designated portion of the insulation supply 38 is properly positioned beneath the die board 28, which has been placed in the staging position. The die board 28 is then moved from the staging position toward the task completion position. As the die board 28 continues to be moved toward the task completion position, the die blades 32 and cutters 34 begin cutting the insulation supply 38. As the die blades 32 and cutters 34 complete the cutting of the insulation supply 38, the pins 36 form the perforations 26. As the pins 36 form the perforations 26, the adhesive 24 is pushed out of the way so that the perforations 26 are substantially free or void of the adhesive 24. Having formed the perforations and completed the cutting of the insulation supply 38, the die board 28 reaches the task completion position. At this point, the insulation assembly 16 has been formed. The die board 28 is then returned to the staging position and the cycle is repeated.

While it is preferable for the formation of the perforations 26 and the cutting of the insulation supply 38 to be performed during a common operational stage (i.e. by the same die board 28), the formation of the perforations 26 and the cutting of the insulation supply 38 may be performed during different operational stages. That is to say, separate die boards (not shown) may be used to form the perforations 26 and to cut the insulation supply 38. In such a case, the perforations 26 may be formed prior to or after the cutting of the insulation supply 38. Additionally, a rotary die board of a suitable type may be used to form the perforations 26 and to cut insulation supply 38 in a continuous operation.

It should be appreciated that the insulation supply 38 may be provided to the fabricator of the insulation assembly 16 in a precut condition so as to form an insulation blank having the shape and size of the insulation assembly 16. If so, the fabricator of the insulation assembly 16 need only form the perforations 26 to complete the formation of the insulation assembly 16.

It should also be appreciated that the supply of the facing layer 20' and the supply of the insulation layer 18' may be provided separately to the fabricator of insulation assembly 16. In such a case, the insulation assembly 16 is made by introducing the adhesive 24 and aligning the insulation layer 18' and the facing layer 20' with respect to each other so that the adhesive 24 is between the insulation layer 18' and the facing layer 20'. The adhesive 24 may be introduced in spray form between the insulation layer 18' and the facing layer 20' at the same time that the insulation layer 18' and the facing layer 20' are joined together to form the insulation supply 38. Alternatively, the adhesive 24 may be introduced, by spraying, brushing, introducing a film, rolling, or the like, to at least one of the insulation layer 18' and the facing layer 20' prior to joining the insulation layer 18' and the facing layer 20' to each other. Having formed the insulation supply 38, the adhesive 24 is preferably cured prior to forming the perforations 26. The insulation supply 38 is then staged in relationship to the die board 28 so that the die board 28 may complete the formation of the insulation assembly 16 as described above. Alternatively, as described above, the insulation supply 38 may first be cut to the shape and size of the insulation assembly 16 to form an insulation blank prior to forming the perforations 26, or the perforations 26 may be formed prior to cutting the insulation supply 38.

The principle and mode of operation of this invention have been described in its preferred embodiments. However, it should be noted that this invention may be practiced otherwise than as specifically illustrated and described without departing from its scope.

What is claimed is:

1. An insulation assembly for a forced gas unit comprising:

an insulation layer;

a facing layer including at least one non-pressure-balancing region having no perforations formed therein and a pressure-balancing region having perforations formed in said facing layer; and an adhesive attaching said facing layer and said insulation layer to each other, wherein said at least one non-pressure-balancing region is substantially impervious to the passage of gas and said perforations are substantially void of said adhesive to allow gas flow through said facing layer.

2. The insulation assembly according to claim 1 wherein said perforations have sizes within the range of from about 0.002 to about 0.320 square inches.

3. The insulation assembly according to claim 1 wherein said perforations have a concentration within the range of from about 0.5 to about 4 perforations per square inch.

4. The insulation assembly according to claim 1 wherein said insulation assembly satisfactorily passes the flame spread and smoke development test defined in UL 2550 when installed in an HVAC unit.

5. The insulation assembly according to claim 1 wherein the total portion of said facing layer covered by said at least one non-pressure-balancing region is within the range of from about 30 to about 90 percent of the area of said facing layer.

6. The insulation assembly according to claim 1 wherein said adhesive is applied to substantially the entire surface of at least one of said insulation layer and said facing layer.

7. A forced gas unit comprising:

a housing including interconnected panels;

a blower disposed in said housing; and an insulation assembly attached to an inner surface of said housing, said insulation assembly comprising:

an insulation layer;

a facing layer including at least one non-pressure-balancing region having no perforations formed therein and a pressure-balancing region having perforations formed in said facing layer; and an adhesive attaching said facing layer and said insulation layer to each other, wherein said at least one non-pressure-balancing region is substantially impervious to the passage of gas and said perforations are substantially void of said adhesive to allow gas flow through said facing layer.

8. The forced gas unit according to claim 7 wherein said insulation layer is porous.

9. The forced gas unit according to claim 7 wherein said insulation assembly includes two columns of spaced-apart folding slits formed through each of said insulation layer and said facing layer, said columns of said folding slits dividing said insulation assembly into panels which align with said panels of said housing.

10. The forced gas unit according to claim 7 wherein said facing layer is formed from a moisture resistant material that acts as a moisture barrier for limiting the amount of water vapor condensing on said insulation layer.

11. The forced gas unit according to claim 7 wherein said facing layer is formed from a wind and heat resistant material that acts as a windshield for limiting the amount of erosion to said insulation layer and as a heat shield for limiting the amount of heat transferred by convention through said insulation layer.

12. The forced gas unit according to claim 7 wherein said pressure-balancing regions are remotely located from said blower.

13. The forced gas unit according to claim 7 wherein at least a portion of one of said panels is removable to allow access within said housing.

* * * * *